United States Patent [19]

Golding

[11] 4,150,771

[45] Apr. 24, 1979

[54] BEER KEG TAPPING CLOSURE UNITS

[75] Inventor: Cyril G. Golding, Sedgeley, England

[73] Assignee: GKN Sankey Limited, Bilston, England

[21] Appl. No.: 780,798

[22] Filed: Mar. 24, 1977

[30] Foreign Application Priority Data

| | | | |
|---|---|---|---|
| Mar. 27, 1976 | [GB] | United Kingdom | 12425/76 |
| Aug. 20, 1976 | [GB] | United Kingdom | 34778/76 |
| Dec. 4, 1976 | [GB] | United Kingdom | 50660/76 |

[51] Int. Cl.[2] ..... B65D 83/00

[52] U.S. Cl. ..... 222/400.7; 137/212

[58] Field of Search ..... 222/400.7, 400.8; 285/DIG. 22; 137/212

[56] References Cited

U.S. PATENT DOCUMENTS

| | | | |
|---|---|---|---|
| 3,036,586 | 5/1962 | Reeve | 222/400.7 X |
| 3,784,235 | 1/1974 | Kessler et al. | 285/DIG. 22 |
| 3,826,523 | 7/1974 | Eschbaugh | 285/DIG. 22 |
| 3,939,860 | 2/1976 | Golding | 222/400.7 X |
| 3,958,719 | 5/1976 | Ward | 285/DIG. 22 |

FOREIGN PATENT DOCUMENTS

| | | | |
|---|---|---|---|
| 958111 | 5/1963 | United Kingdom | 222/400.7 |
| 1281573 | 7/1972 | United Kingdom | 222/400.7 |

*Primary Examiner*—David A. Scherbel

*Attorney, Agent, or Firm*—Merriam, Marshall & Bicknell

[57] ABSTRACT

A bush for a valved closure unit of the kind used in beer kegs comprising a two-part bush which engages an opening in the keg. One part of the bush which engages the opening, is in the form of a hot brasss stamping or stainless steel or aluminium casting. The other part of the bush is of stainless steel and is held in the first part by an interference fit and/or interfitting ribs and grooves and/or adhesive. The interstices between the parts are sealed by a sealant.

12 Claims, 7 Drawing Figures

BEER KEG TAPPING CLOSURE UNITS

This invention relates to valved closure units for containers. Such closure units are widely used in beer kegs and the units are arranged so that the containers may be emptied and filled through the closure units.

More specifically, the invention relates to closure units of the kind, hereinafter referred to as being of the kind specified, which comprises a bush arranged to be received in an opening in a container or keg, the bush normally being externally threaded near one end for threaded insertion into an internally threaded neck on the container, a downtube supported by the bush for extending into the container and spring-loaded valve means within the bush and associated with the downtube.

When the unit is used in a beer keg, the valve means are arranged to control the entry of carbon dioxide and the exit of beer from a full keg. Moreover, the valve means can be used to control the entry and exit of washing liquid and/or steam during washing of the keg and the entry of beer during filling of the keg. Normally, the valve means will be one of two types. The valve means will either comprise two concentric valves, one for beer and one for gas, each of the valves being separetely spring loaded, or there may be a single valve member controlling separate beer and gas passages.

Heretofore, the bush of a closure unit of the kind specified has been made as a one-piece casting of stainless steel or aluminium or as a hot brass stamping and subsequently machined where necessary, the machining including producing a valve seat on the bush for the valve means and an external screw thread. Where the bush is of brass it has been chrome plated and where it has been of aluminium it has been anodised and epoxy coated. Such bushes of stainless steel are satisfactory but they are expensive and tend to pick-up when threadedly engaged in stainless neck fittings. However such bushes have good corrosion resistance. Chromed brass bushes do not pick up but the plating deteriorates and is damaged in use. Anodised and epoxy coated aluminium bushes do not pick up but are more susceptible to damage than chromed brass bushes. It is an object of the present invention to provide improved forms of bush for a closure unit of the kind specified.

According to one aspect of the invention we provide a two-part bush for a closure unit of the kind specified, the bush comprising a first, annular, metal part which has been formed by casting or hot stamping and having, in one end, a counterbore; a second part in the form of a stainless steel tubular member held permanently and firmly in the counterbore; and a sealant filling interstices between the first and second parts, the tubular member extending outwardly from the counterbore and being formed with support means enabling a spring abutment to be engaged therewith and supported thereon.

Normally the first part will have an external screw thread at the end thereof opposite from the counterbore, this thread enabling a unit including the bush to be received in an internally threaded neck on a container.

The first part may be formed from stainless steel by investment or die casting. If so the bush will be made wholly of stainless steel and will be cheaper than the known one-piece cast bushes. Alternatively the first part may be a hot brass stamping which has been chrome plated or an aluminium casting which has been anodised and epoxy coated. If so, the part of the bush most prone to corrosion, i.e. the second part, will be of stainless steel so that the bush as a whole will have better corrosion-resistance properties than known one-piece brass or aluminium bushes, while in addition having the advantage of known brass or aluminium bushes that they do not pick-up when screwed into stainless steel necks on kegs. Where stainless steel bushes are fitted into stainless steel necks it is usual to wrap the male thread with PTFE tape to avoid the threads picking up.

Internally of the first part and adjacent to the threaded end thereof there may be provided lugs to engage a coupling device which, when the bush is in a unit, opens the normally closed valve means thus to establish communication between the downtube and the interior of the container and the coupling device. Instead of having internal lugs, the first part may have an external flange shaped to allow a coupling device to be engaged therewith. When used with a beer keg, the coupling device will be in the form of a dispense head which can be coupled to the closure unit to open the valve means and thus to allow carbon dioxide to be supplied to the keg and beer to be removed therefrom. Similarly the internal lugs or external flange can be used to engage another coupling device during washing and filling of the container.

The second part will have holes in the tubular wall thereof between the free ends of the second part and the open end of the counterbore. The support means are preferably provided by inwardly deformed portions of the wall of the second part adjacent to the free end thereof. These inwardly deformed portions may be such as to enable an appropriately shaped abutment to be engaged therewith by way of a bayonet-type connection.

In one arrangement of the bush the parts are held together by the second part having been forced into the counterbore so as to be held firmly therein by interference between the inner and outer surfaces of the counterbore and the second part respectively. The interference between the first and second parts must be such as to withstand the spring force and must also be such as to withstand vibration to which the unit is exposed in use, particularly during transport.

The said parts of the bush may be held positively against axial separation by interfitting formations which may be a circumferential groove in one part engaged by a circumferential rib on the other part.

Preferably there is a groove and rib on each part engaging respectively a rib and groove on the other part. Preferably, the circumferential rib on the second part is adjacent to the end thereof which is within the counterbore in the first part, and is externally chamfered to give a lead as the second part is entered into the counterbore in the first part. If desired an interference fit can be provided between the first and second parts which prevents relative rotation between the parts. Preferably the interference fit takes place between the base of the groove in the second part and the interfitting rib on the first part. Alternatively relative rotation between the parts is prevented by an adhesive between the parts or by mechanical means such as an axial ridge on one part engaging in an axial trough in the other part.

Preferably the second part is of a material sufficiently resilient, or having sufficient memory for shape, for said rib on the second part to be resiliently deflected inwardly as the second part is entered into the counterbore of the first part and then to enter the interfitting groove in the first part; the parts thus "snap" together. If an interference fit is required then the first part may be contracted, after the second part has been inserted in the counterbore, by a contracting tool applied to the exterior of the first part. Alternatively, the rib on said end of the second part can be forced outwardly into the groove in the first part while the latter is held against radial expansion.

In another arrangement the second part is held in the first part by an adhesive and means such as a co-operating axial ridge and trough may be provided on the parts to prevent relative rotation thereof.

In some embodiments of the invention the first part is provided with an internal valve seat with which the valve means co-operates. This internal valve seat may be convergent and may be frusto-conical or part-spherical.

In some arrangements the end portion of the second part within the counterbore provides a seat for the valve means. Such seat may be provided by an internal flange on said end portion. The flange may be supported by a shoulder on the first part. The first part may have an inwardly extending flange overlying the internal flange on said end portion, the flange on the first part providing an upper surface against which part of the dispense head seals when the unit is in service in a beer keg. The two flanges together resist the downward sealing force of the dispense head.

In a further arrangement the valve seat is provided by a length of the second part whose wall thickness increases progressively in a direction towards the inner end of the counterbore so as to provide said length with a frusto-conical or part-spherical inner surface.

The immediately foregoing construction provides a valve seat whose dimension, considered axially of the bush, is appreciably greater than that which can be provided if the seat is formed by an internal flange on the second part as described above. This enables the valve seat to provide guidance for the valve means as it moves towards and away from the valve seat and makes the provision of separate guidance means unnescessary.

The invention also includes a closure unit of the kind specified including a two-part bush as described above, a downtube supported within the bush, valve means associated with the downtube and the bush and urged by spring means within the bush to engage a valve seat on the bush, the spring means surrounding the downtube, and a spring abutment engaged by the spring and surrounding the downtube within the second part of the bush and supported in the second part adjacent the free end thereof by said support means.

The invention will now be described by way of example with reference to the accompanying drawings in which.

Figure 1:
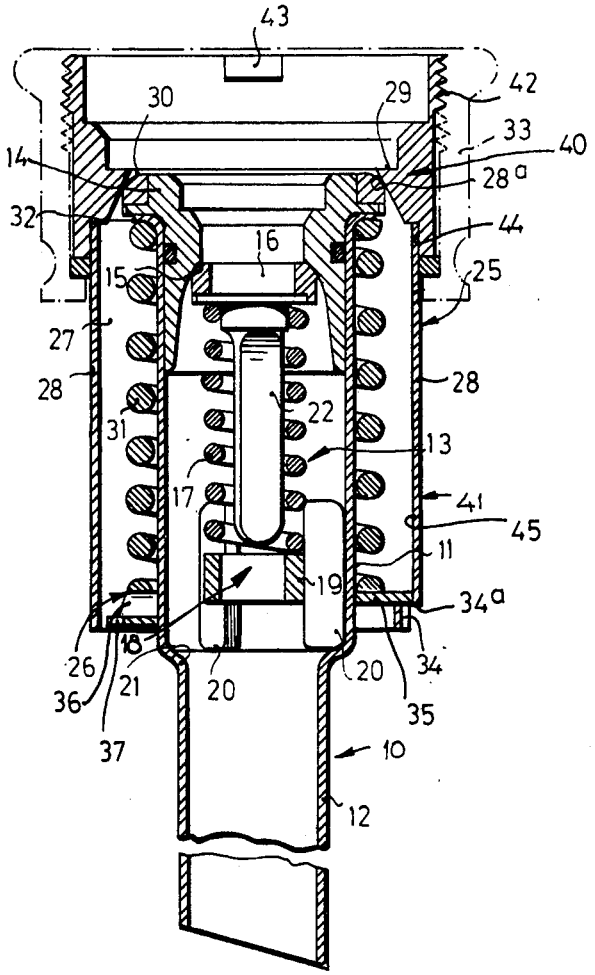
FIG. 1 is a section through a bush and closure unit constituting a first embodiment of the invention.

Referring now to FIG. 1, the closure unit comprises a downtube 10 having an upper portion 11 of larger diameter than a lower portion 12. The portion 11 provides a chamber 13 in which is mounted a beer valve 16. The valve 16 engages a seat 15 on a gas valve 14 which is received within the portion 11 of the downtube. The valve 16 is urged upwardly by a spring 17 which engages on a ring 19 forming part of a spider 18 which has three equiangularly spaced legs 20 which engage with a shoulder 21 between the parts 11 and 12 of the downtube.

The valve 14 has bonded thereto a rubber ring 30 which engages a valve seat **28*a* on a bush 25. The valve 14 fits within the upper end of the part 11 of the downtube against a flange 32 and a spring 31 engages the flange 32 and also a washer 26 which rests on inwardly deformed portions 34 on the bush formed as will be described below. The washer 26 has three recesses 37 which can clear the portions 34, the recesses 37 being formed in three circumferentially spaced portions 36 which are interposed between three circumferentially spaced portions 35, the portions 35 and 36 being at different levels. In use the unit is received in an internally threaded neck 33** secured to a container, not shown.

The bush 25 comprises a first part 40 which has been formed by casting or hot stamping and a second part 41 which is a stainless steel tube. The part 40 may be formed as a stainless steel investment casting or aluminium die casting or as a hot brass stamping. After casting or stamping the part will be machined as required and if made of brass will be chrome plated and if made of aluminium will be anodised and epoxy coated. The part 40 is of annular form and is provided with an internal annular shoulder 29 which is machined to produce the valve seat **28*a* which is frusto-conical or may be part-spherical. The part 40 is provided with an external screw thread 42 which can engage with the internal thread on the neck 33. The part 40 is also provided with two diametrically spaced internal lugs, one of which is shown at 43. These lugs are arranged to engage a dispense head or other coupling means which can be engaged with the part 40 to open valves 14 and 16**.

The first part 40 is provided with a counterbore 44 in which is received one end of the second part 41. This part 41 is made from commercially available stainless steel tube and is provided with three equiangularly spaced apertures 28 arranged just below the bottom of the neck 33 so that when the container is inverted during washing it can drain completely through the unit. The three inwardly deformed portions 34 are provided by slitting the tube at **34*a* and then bending the parts inwardly. The washer 26 can be engaged in the lower end of the part 41 by arranging the recesses 37 opposite to the inwardly deformed portions 34 then pushing the washer through into the bore 45 of the part 41 and then turning the washer so that the inwardly deformed portions 34 engage the parts 35. The washer 26 provides an abutment for the spring 31 and is supported on the inwardly deformed portions 34**.

The length of tube 41 forming the second part of the bush is, during manufacture of the bush, forced into the counterbore 44. The interference between the counterbore and the tube is sufficient to resist the spring force and vibration when the unit is in use and we have found that an interference of between 0.3 and 0.5 mm on a diameter of about 44 mm is satisfactory. The upper end of the tubular part 41 may be slightly chamfered to give the tube a lead into the counterbore 44. After the tube has been forced into the counterbore, the bush is treated with resin to seal the interstices of the joint between the parts 40 and 41.

After casting or stamping the first part 40 is machined as required to provide the valve seat 28*a* and any other important surfaces. If the first part is made of a hot brass stamping it is then chrome plated. The stainless steel tube 41 is then forced into the counterbore 44. The assembled bush is then cleaned by a known method of electropolishing which involves an electrolytic step which etches the surfaces of the parts.

The cleaned bush is then placed in a vacuum chamber, the pressure in the chamber is reduced to a low level and the chamber is then filled with resin. The resin migrates to the interstices between the first and second parts (40 and 41) of the bush and lodges therein. The bush is then removed from the resin and washed to remove all the resin from the external surfaces. The bush is then heated in hot air to a temperature of between 130° and 140° C. for at least four hours. The resin which is used in a non-toxic polyester or epoxy resin suitable for metal sealing, for example the epoxy resin sold under the designation V15 and formulated by Industrial Impregnations Limited, and this hot air treatment cures the resin in the interstices between the first and second parts of the bush and thus prevents such interstices becoming a bacterial trap. Finally, the bush is wet blasted to remove any traces of resin on the surface which were not removed by the washing.

Figure 2:
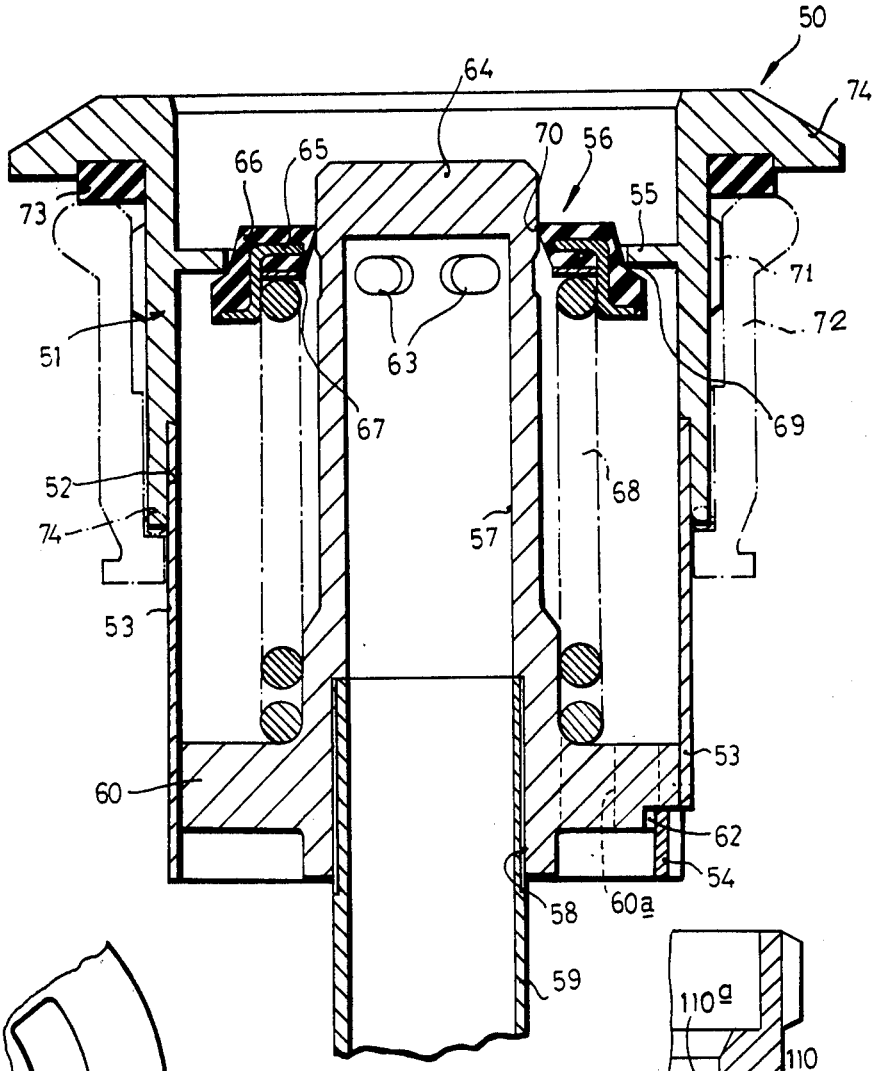
FIG. 2 is a section through a bush and closure unit constituting a second embodiment of the invention.

The embodiment so far described has two concentric valves 14 and 16. FIG. 2 shows a second embodiment having a single valve member which controls both the gas and beer passages.

Figure 3:
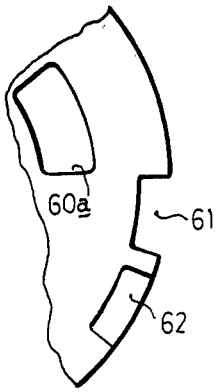
FIG. 3 is a detailed view of the spring abutment washer of the unit of FIG. 2.

Referring to FIGS. 2 and 3 the bush is indicated at 50 and comprises a first part 51 which is made either as a casting or stamping as described for the part 40. The part 51 is provided with a counterbore 52 in which is received a stainless steel tube 53. The tube has been forced into the counterbore as described above in relation to the embodiment of FIG. 1. The lower end of the tube 53 has support means 54 which is similar to the means 34 described and shown in FIG. 1.

The part 51 is provided with an internal flange 55 which provides a seat for a valve member 56. The valve member is slidable upon a central tube 57 forming the upper end of a downtube and which is internally threaded at 58 to receive the lower portion 59 of the downtube. The central tube 57 has a collar 60 which fits closely within the tube 53. The collar is provided with three slots, one of which is shown at 61 in FIG. 3, to pass the support means 54 and with three locking recesses 62 to receive the support means 54 once the collar has been inserted in the tube 53 with the support means 54 aligned with the slots 61 and then turned to enable the support means 54 to be received in the recesses 62. The central tube 57 has ports 63 at its upper end which is closed at 64. The collar 60 has drain slots 60*a*.

The valve member 56 comprises a Z-shaped metal reinforcing member which is embedded in a rubber ring 66. The rubber ring 66 carries an external metal washer 67 which is engaged by the upper end of the spring 68 whose lower end engages spring support means provided by the collar 60. The rubber ring 66 seals on the seating 55 at 69 and on the central tube 57 at 70.

The part 51 is provided with an external screw thread 71 which is received in a neck 72 secured to a container, not shown. The part 51 is sealed to the neck 72 by means of a rubber ring 73 and is provided with a flange 74 which is of circular shape with a number of flats thereon so that it may be engaged by a collar carried by a dispense head. Alternatively the part 51 may be sealed in the neck 72 by an O-ring 74 at the bottom of the part 51.

The bush 50 is made in the same manner as described in relation to FIG. 1 and the interstices between the first and second parts thereof are filled with resin to avoid bacteria traps. The closure unit is shown in its closed position in FIG. 2 but is opened by engaging the valve member 56 and moving it downwardly which simultaneously opens the ports 63 and also the passage between the central tube 57 and the bush.

Figure 4:
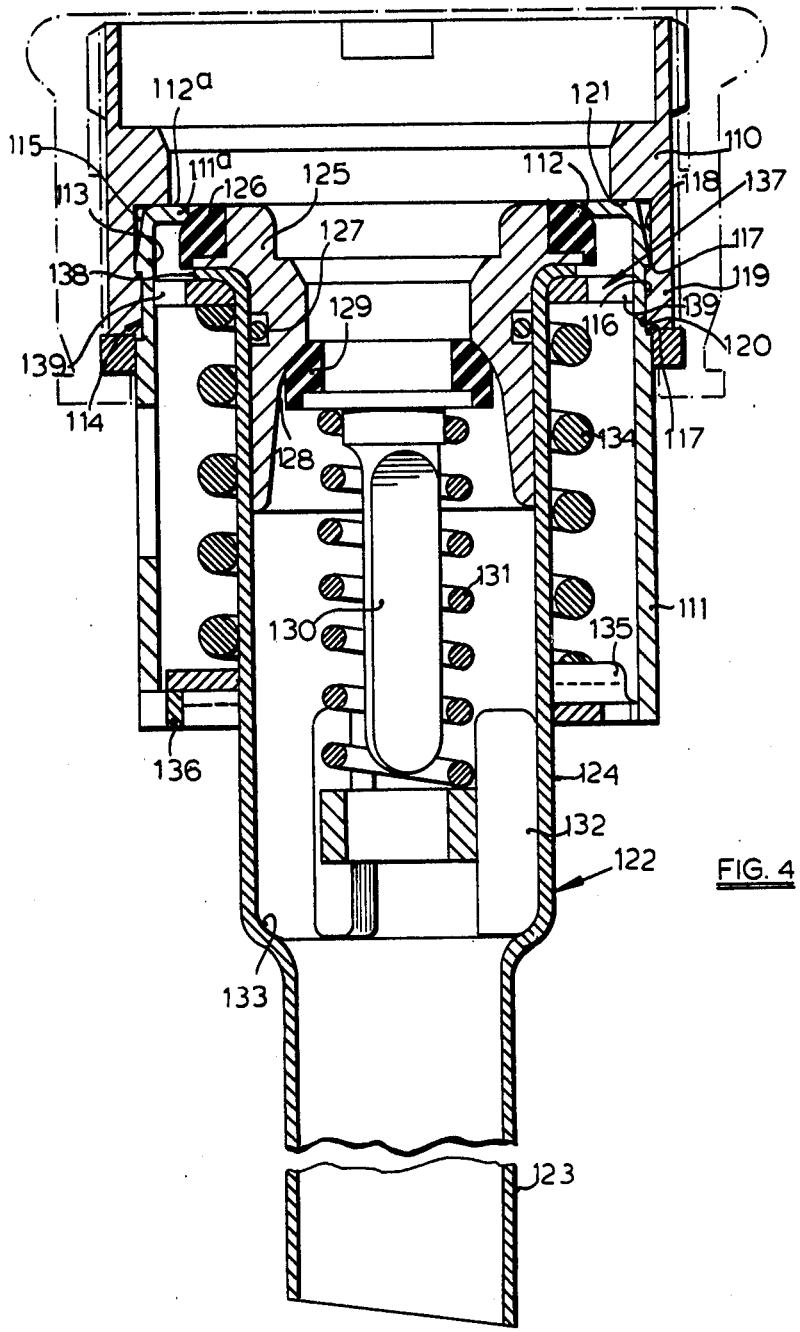
FIG. 4 is a section through a bush and closure unit constituting a third embodiment of the invention.

Referring now to FIG. 4 this shows a third embodiment of the invention in which the two part bush comprises a first part 110 which is a casting or stamping made as described for the part 40 and a second part 111 which is a stainless steel tubular member either formed of tube or made by deep drawing as described below. The part 111 has an inturned flange 111*a* which provides a valve seat 112. The parts 110 and 111 are interfitted by ribs and grooves. The upper end of the part 111 has a rib 113 and a groove 114. The rib 113 has a chamfered surface 115 and the groove 114 and a base 116 and side walls 117. The lower end of the first part 110 has a groove 118 and a rib 119 adjacent thereto. The rib 113 is received in the groove 118 and the rib 119 is received in the groove 114. Since the rib 113 overlies the rib 119 the parts 110 and 111 are positively located against axial separation. There is also an interference fit between the base 116 of the groove 114 and the rib 119. This interference fit may be obtained by contracting the part 110 around the part 111 (which is internally supported) either by a segmental contracting tool or a tool having a tapering bore.

The bush is assembled by entering the upper end of the part 111 into the counterbore 120 in the lower end of the first part 110. The chamfered surface 115 engages the lower corner of the rib 119 so that the upper end of the part 111 is deflected inwardly as it is pushed into the first part. Once the rib 113 is clear of the rib 119 it springs back to the position shown in FIG. 4 overlying the rib 119 and thus providing a positive location against axial separation of the parts. Contraction of the part 110 is then effected.

In an alternative method of assembly the upper end of the tube 111 is entered into the counterbore 120 with the rib 113 deflected inwardly clear of the rib 119 and then the upper part of the tube is expanded to cause the rib 113 to enter the groove 118 while supporting the exterior of the first part 110 to prevent radial expansion thereof during this forming operation.

The bush once assembled is cleaned and the interstices filled with resin as described above.

Figure 5:
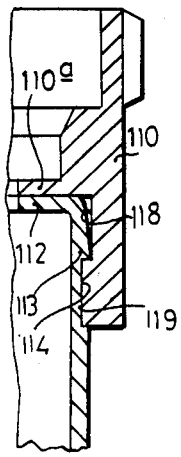
FIG. 5 is a detail section of a modification of the embodiment shown in FIG. 4.

The flange 111*a* is supported on a shoulder 121 in the first part and provides the valve seat 112. The upper surface 112*a* of the flange 112 provides a sealing surface for part of a dispense head when the unit is in use. FIG. 5 shows a modification in which the flange 112 engages the underside of an internal flange 110*a* formed on the first part 110 and in this modification the upper surface of the flange 110*a* provides the sealing surface for the dispense head. The combined strength of the flanges 110*a* and 112 withstands the sealing pressure and prevents deformation of the flange 112 which may happen if the flange 110*a* is not present and the sealing pressure is increased beyond that normally encountered due, for example, to misuse of the dispense head.

In addition to the bush, the closure unit of FIG. 4 includes a downtube 122 having a lower portion 123 of smaller diameter and an upper portion 124 of larger diameter. Fitting within the upper end of the portion 124 is a gas valve 125 and this carries a rubber seating 126 which engages with the seat 112 on the flange 111*a*. The gas valve is sealed to the portion 124 of the downtube by means of an O-ring 127. The gas valve has an internal seat 128 which is engaged by a rubber seating 129 on a beer valve 130. The beer valve is urged upwardly by a spring 131 into engagement with the seat 128, the spring engaging a spider 132 which engages a shoulder 133 between the parts 123 and 124 of the downtube 122.

The gas valve 125 is urged into engagement with the seat 112 by a spring 134 which engages a washer 135 which in turn is supported on parts 136 inset from the lower edge of the part 111 as described in relation to FIG. 1. The spring 134 also acts against a washer 137 which in turn engages under a flange 138 at the top of the downtube. The washer 137 moves freely within the cylindrical part of the tubular member 111, the radial clearance between the washer and the tubular member being no more than required for free movement so that the washer can guide the valve 125 onto its seat as the valve closes. The washer 137 is provided with a plurality of cutouts such as 139 to enable gas to flow past the washer.

Figure 6:
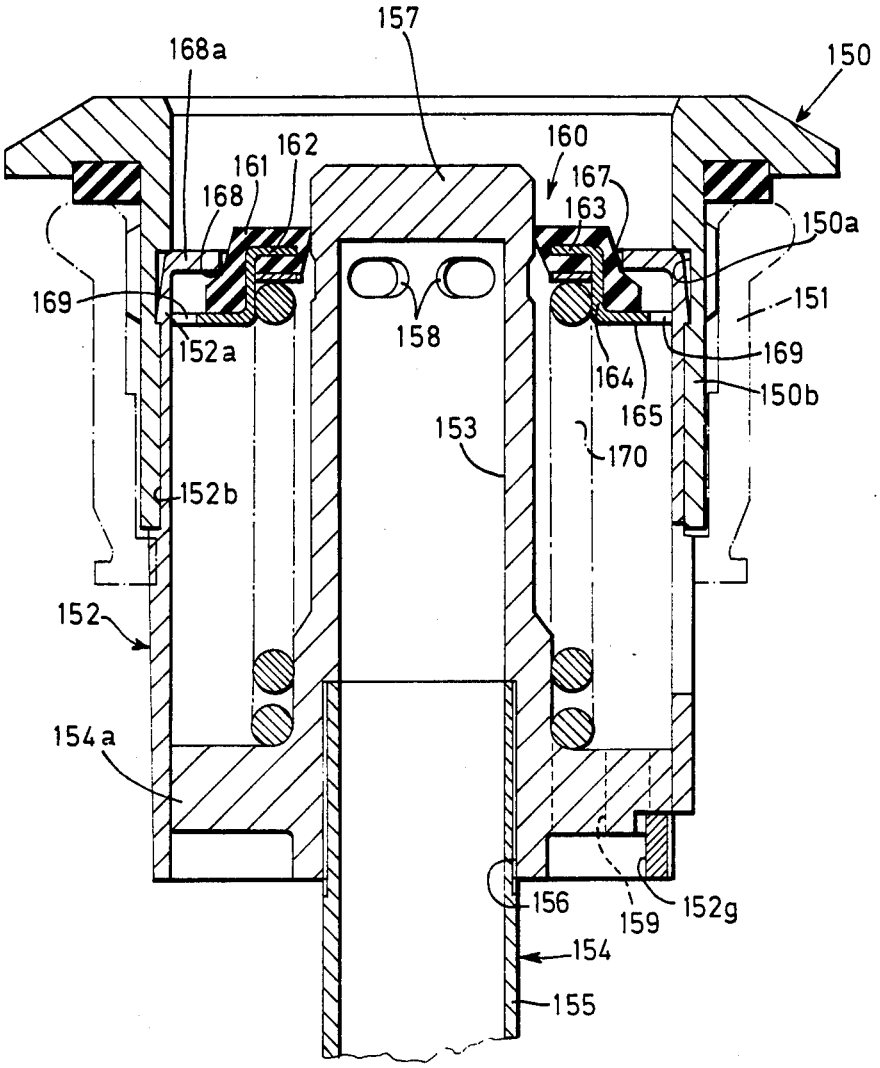
FIG. 6 is a section through a bush and closure unit constituting a fifth embodiment of the invention.

FIG. 6 shows another form of unit including a bush embodying the invention. There is a two-part bush comprising a flanged upper part 150 (made as a casting or stamping as described for the part 40) which is threadedly engaged in a container neck 151. A lower tubular part 152 is engaged with a snap-in and interference fit in the bush part 151. Thus the part 150 has a groove 150*a* and a rib 150*b* which interfit with a rib 152*a* and a groove 152*b* on the part 152. There is an interference fit between the rib 150*b* and the groove 152*b*. The upper part 153 of the downtube 154 has a flange 154*a* which fits closely with a bayonet connection into the lower tubular part 152 and rests on inset parts 152*c* at the lower end of the part. The lower part of the downtube is indicated at 155 and is received in a counterbore 156 in the part 154. The upper part 153 of the downtube is closed at 157 at its upper end and is provided with ports 158 therein. Ports 159 are also provided in the flange 154*a*.

A valve member 160 is slidable about the downtube and comprises a rubber or similar member 161 which is carried by a washer 162 of generally Z-shape in section. The washer has a central flange 163, a cylindrical portion 164 and a flat portion 165. The rubber member 161 encapsulates the washer 162 and a part of the rubber member 161 has a conical surface 167 which engages a seat 168 formed on a flange 168*a* of the tubular member 152. The flat part 165 of the washer has cutouts 169 around its periphery to enable gas and beer to flow between the downtube and the bush.

The closure unit is shown in its closed position; to open it, the valve member 160 is depressed thus moving the valve member against a spring 170 (which biases the valve member to a closed position) so that the ports 158 are exposed and an opening is provided between the seat 168 and the valve member. Because the seat 168 is formed by an inturned flange it gives little guidance to the valve member but this is guided by engagement of the periphery of the flat part 165 of the washer with the bore of the tubular member 152.

Figure 7:
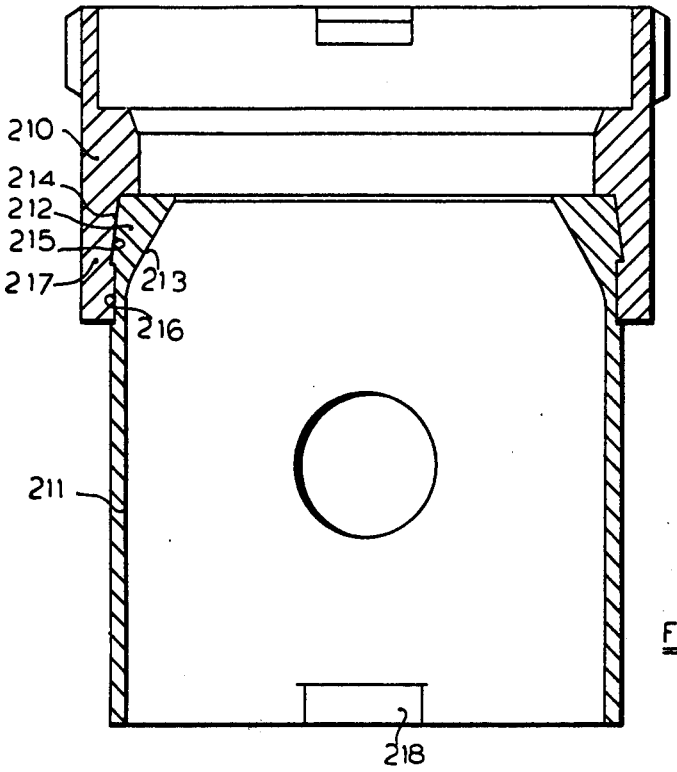
FIG. 7 is a section through a bush constituting a sixth embodiment of the invention.

FIG. 7 shows a bush which comprises a first part 210 in the form of a hot brass stamping which has been chromium plated or an aluminium die casting which has been anodised and epoxy coated and a second part 211 which is a tubular member cast in stainless steel.

The part 211 has a thickened end portion 212 whose inner surface 213 is of frusto-conical form. This surface acts as a valve seat for a valve (not shown) similar to, for example, the valve 14 or 125 of FIG. 1 or 4. The surface 213 could be part-spherical if desired. The outer surface 214 of the end portion 212 provides a rib of frusto-conical form and is received within a groove 215 in the first part 210. A groove 216 in the outer surface of the tubular member 211 also receives an internal rib 217 on the first part 210.

The interlock between the groove 214 and the rib 212 and the groove 216 and the rib 217 prevents the separation of the first part 210 and the tubular member 211 in a manner similar to that described in relation to FIGS. 4 and 6. Any interstices formed between the mating surfaces of the first part 210 and the tubular member 211 are filled by sealant material as described above. The free end of the tubular member 211 is provided with circumferentially spaced inset parts 218 for supporting a washer such as 26 or 135.

Various modifications may be made to the bush as described in detail. In a first modification a mechanical interlock to prevent axial separation of the parts 110 and 111 or 150 and 152 by means of the ribs and grooves will be provided but there will be no interference fit between the rib 119 or 150*b* and the groove 114 or 152*b*. Means will be provided for preventing relative rotation between the parts 110 and 111 or 150 and 152. Such means may be an adhesive between the parts or there may be a longitudinal ridge on the part engaging a longitudinal trough in the other to prevent relative rotation.

In another modification the part 41 or 53 may be inserted into a counterbore in the part 40 or 50 with clearance and the parts held together by a suitable adhesive. There may be an axial ridge on one part and an axial trough on the other part which interengage to prevent relative rotation between the parts.

The part 111 or 152 may be made from stainless steel tube. Alternatively, the part may be made by deep drawing so as to form a cup with cylindrical walls and a circular base. This base is then pierced to provide e.g. the flange 111*a*, 168*a* and the flange at the other end of the tubular member which will have been formed during drawing will be clipped and the drawing then continued to wipe in the edge portion of the tubular member.

The invention provides a bush in which the second part is made of stainless steel. This is the part which we have found to be the most subject to damage and corrosion when made of chromed brass or coated aluminium. A bush embodying the invention in which the first part is made of chromed brass or coated aluminium and the second part of stainless steel therefore gives a much better service performance than the previously used, one-piece chromed brass or coated aluminium bushes. Moreover the chromed brass or aluminium first part can be screwed into a stainless steel neck without the risk of the threads of the neck and the bush picking up.

A bush in which the first part is made of stainless steel by casting and the second part of stainless steel tube (or by deep drawing) gives a performance comparable to the one-piece stainless steel bushes heretofore used but at less cost.

I claim:

1. A two-part bush for a closure unit, the bush comprising:

a first annular metal part having a counterbore in one end;

a second part in the form of a stainless steel tubular member having a first end portion fixedly held in the counterbore, the tubular member extending outwardly from the counterbore and having support means enabling a spring abutment to be engaged therewith and supported thereon; and the first end portion of the tubular member second part having a flange on the end projecting inwardly and the flange having a valve seat for a valve means.

2. A bush according to claim 1 wherein the first part has an external screw thread thereby enabling the unit to be received in an internally-threaded neck on a container.

3. A bush according to claim 1 in which the first part has an inwardly extending flange above and in contact with the flange on the second part of the bush.

4. A bush according to claim 1 in which the first part is a metal casting or hot stamping.

5. A bush according to claim 4 in which the metal of the first part is plated brass or coated aluminum.

6. A bush according to claim 1 in which the second part is fixedly held in the counterbore of the first part by interference between the inner and outer surfaces of the counterbore and the second part respectively.

7. A bush according to claim 6 in which a solid polymeric sealant material fills interstices between the first and second parts joined by said interference.

8. A closure unit comprising:

a bush comprising a first annular metal part having a counterbore in one end, a second part in the form of a stainless steel tubular member having a first end portion fixedly held in the counterbore, the tubular member extending outwardly from the counterbore and having support means enabling a spring abutment to be engaged therewith and supported thereon, and the first end portion of the tubular member second part having a flange on the end projecting inwardly and the flange having a valve seat for a valve member;

a downtube supported within the bush; and a valve member associated with the downtube and the bush and urged by a spring within the bush to engage a valve seat on the bush, and with the spring surrounding the downtube.

9. A closure unit according to claim 8 in which the spring support means is an abutment within the second part of the bush near a second end of the tubular member, and the spring surrounds the downtube.

10. A closure unit according to claim 8 including a guide member movable with the valve member relative to the bush and dimensioned with respect to the bore of the bush so as to move freely therein parallel to the axis of the downtube to guide the valve member when the latter is moving towards and away from the valve seat to prevent misalignment of the valve member and the seat, said guide member permitting passage of fluid past the guide member.

11. A closure unit according to claim 8 in which the first part of the bush has an external screw thread thereby enabling the unit to be received in an internally-threaded neck on a container.

12. A closure unit according to claim 8 in which the first part of the bush has an inwardly extending flange above and in contact with the flange on the second part of the bush.

* * * * *